United States Patent [19]

Vogel et al.

[11] Patent Number: 4,503,688

[45] Date of Patent: Mar. 12, 1985

[54] CHAIN STITCHING MACHINE, ESPECIALLY STITCHED GOODS MACHINE

[75] Inventors: Wolfgang Vogel, Jahnsdorf; Werner Trinks; Horst Heilmann, both of Karl-Marx-Stadt; Dietmar Grenzendörfer; Dietmar Wolfermann, both of Karl-Marx-Stadt, all of German Democratic Rep.

[73] Assignee: VEB Kombinat Textima, Karl-Marx-Stadt, German Democratic Rep.

[21] Appl. No.: 382,314

[22] Filed: May 26, 1982

[30] Foreign Application Priority Data

Sep. 7, 1981 [DD] German Democratic Rep. ... 233086

[51] Int. Cl.[3] ..... D04B 23/06

[52] U.S. Cl. ..... 66/85 A

[58] Field of Search ..... 66/84 R, 85 A, 214

[56] References Cited

U.S. PATENT DOCUMENTS

| | | | |
|---|---|---|---|
| 2,932,181 | 4/1960 | MacCaffray | 66/8 H |
| 3,603,114 | 9/1971 | Jaskulski | 66/85 A |
| 3,707,853 | 1/1973 | Linder et al. | 66/84 |
| 4,051,698 | 10/1977 | Leonhardt | 66/214 |
| 4,092,838 | 6/1978 | Gangi | 66/214 |

FOREIGN PATENT DOCUMENTS

| | | | |
|---|---|---|---|
| 39820 | 6/1965 | German Dem. Rep. | 66/85 A |
| 45009 | 4/1966 | German Dem. Rep. | 66/85 A |
| 1293087 | 10/1972 | United Kingdom | 66/85 A |

*Primary Examiner*—Ronald Feldbaum
*Attorney, Agent, or Firm*—Jordan and Hamburg

[57] ABSTRACT

The present invention is directed to a warp stitching machine comprising a means for guiding a warp element onto a base material on which the warp element is to be formed into a warp of stitches. This guiding means for the chain element is situated on a bracing means in the warp stitching machine, and is preferably in the form of oblique channels for directing the warp element onto the base material.

10 Claims, 3 Drawing Figures

Figure 1:
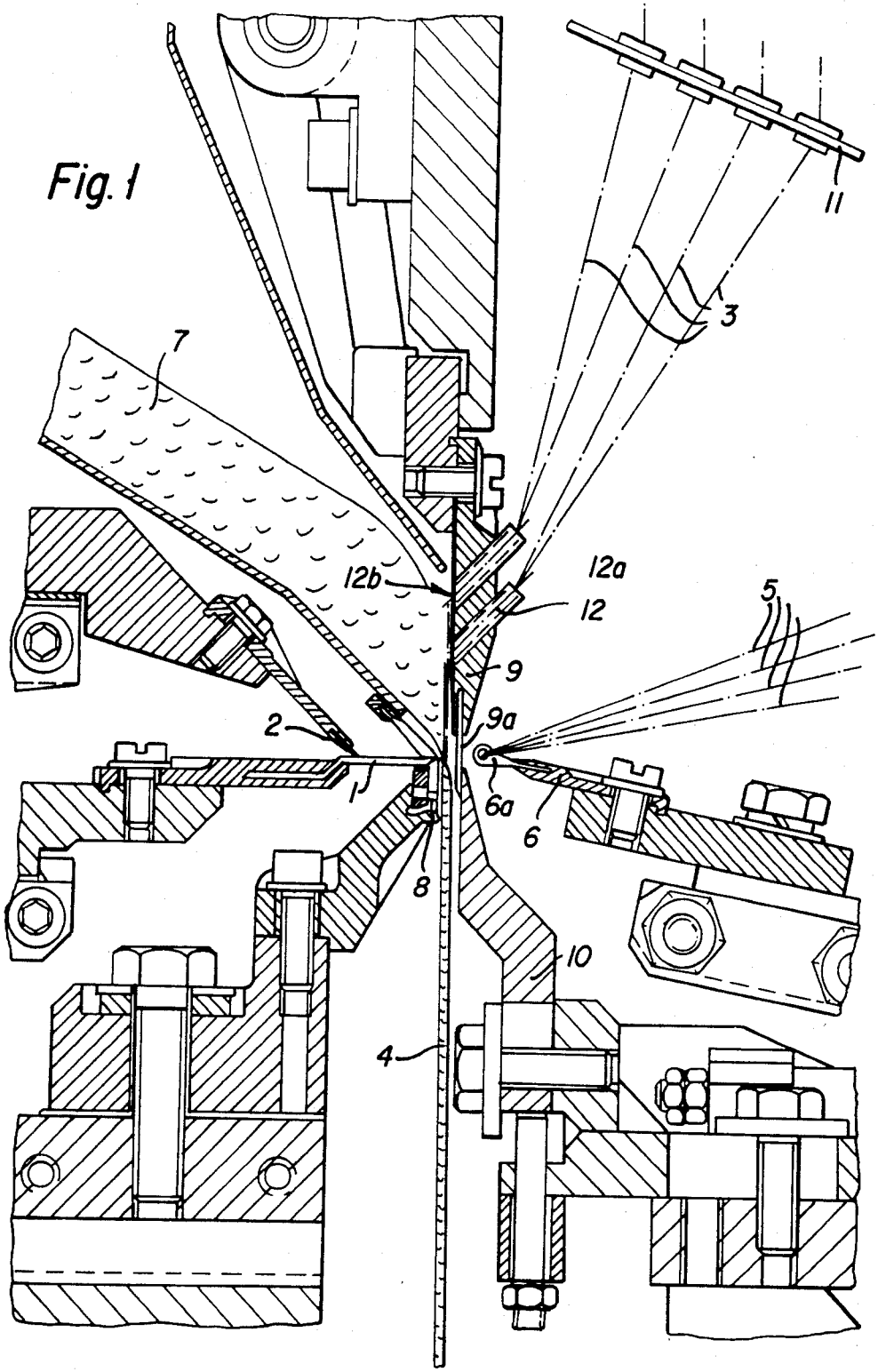

11
3
7
12a
12b
12
5
9
9a
2
1
6a
6
8
10
4

CHAIN STITCHING MACHINE, ESPECIALLY STITCHED GOODS MACHINE

BACKGROUND OF THE INVENTION AND PRIOR ART STATEMENT

This invention relates to a chain stitching machine, especially a stitched goods machine, equipped with sliding needles adjustable back and forth and closing elements for closing the hooks of the sliding needles, a knock-off comb arranged vertically to the latter, an upper and a lower bracing means, both provided parallel to the knock-off comb, as well as with means for guiding the warp elements up to the stitch formation zone and a track provided with perforation needles.

A stitched goods machine of the mentioned type with means for guiding warp elements up to a stitch formation zone in which the machine is adapted to prepare a track on a fleece, is already known. Herein, the warp elements are placed on the left side of the fleece and affixed to the fleece by means of connecting thread (European Patent application No. 0 018 766).

According to one example of an embodiment of the machine presented in the previously mentioned patent application, the guiding of the warp elements occurs in the intermediate zone between the knock-off comb and bracing means on the left side of the fleece facing the bracing means. The bracing means are represented as two tracks parallel to the knock-off comb, being placed apart from each other and over each other. The sliding needles move inside the distance between the tracks when they are driven forward.

The previously known constructions of the stitch formation zone of stitched goods machines do not make it possible to arrange the last guiding elements of the warp elements very near to the center of the stitch formation zone in the intermediate zone between the knock-off comb and the bracing means.

The reasons for this are the acute risk of possible damage to the structure of the fleece through contact with the guiding means and extreme hampering of the operating personnel to draw the warp elements through the last guiding means. In this respect the known machine does not constitute an exception. The necessity to accommodate the means for guiding the warp elements at a relatively large distance from the center of the stitch formation zone results in considerably imprecise guiding of the warp elements immediately over the sliding needles. This, in turn, very often leads to arbitrary positions of the warp elements on the fleece which, in most cases, are undesirable.

Another variant of the machine according to the above European patent application is the guiding of the warp elements in such a way that the same extend towards the center of the stitch formation zone in front of the upper bracing means. For this purpose, a means for guiding the warp elements has been arranged directly above the sliding needles in front of the upper bracing means, said means being formed as a track with openings recessed diagonally in relation to the longitudinal axis of the warp elements, in which such openings face the row of sliding needles in an approximately perpendicular direction. This track does not comprise any bracing pins or the like on which the warp elements could be braced against the stress exerted by the sliding needles to push the warp elements forward from the center of the stitch formation area. Especially in warp elements whose thickness or width is greater than the distance between two adjacent sliding needles, the sliding needles will pierce into the warp elements, in an attempt to involve them in their forward movement, which often occurs. The consequences are disturbances in the manufacturing process of textile goods and quality-lowering deviations in the structure of the latter.

This invention aims at remedying the above mentioned flaws and at making the manufacture of textile goods having warp elements disturbance-free to a very large extent, and wherein the warp elements have an approximately exact position on a base material, such as, for instance, a fleece.

The invention has for its main object the provision of a chain stitching machine, especially a machine for stitched goods, in which the warp elements are located in the center of the stitch formation zone behind the bracing means and in front of the base material, being guided directly over the sliding or reciprocating needles.

SUMMARY OF THE INVENTION

The object of the invention is accomplished by providing means for guiding the warp elements, which are arranged in the upper bracing means, in which the entry openings for the warp elements are located on that side of the upper bracing means that faces the track and wherein passage openings for the warp elements are located on the other side of the bracing means positioned in the intermediate zone between the knock-off comb and the bracing means.

The means for guiding the warp elements should preferably form one structural unit with the upper bracing means. Further, the guiding means of the warp elements may comprise oblique openings which occupy a position directly above the plane of movement of the sliding needles.

When relatively wide warp elements are to be guided, the distance from opening to opening is substantially larger than the separation of the rows of sliding needles. The openings may be arranged in one or several rows and may be displaced in their position from row to row.

The invention results in advantages such that the warp elements are guided exactly directly over the sliding needles and cannot be pushed forward from the center of the stitch formation zone by the sliding needles.

The invention will be explained in more detail by way of the following embodiment.

Figure 2:
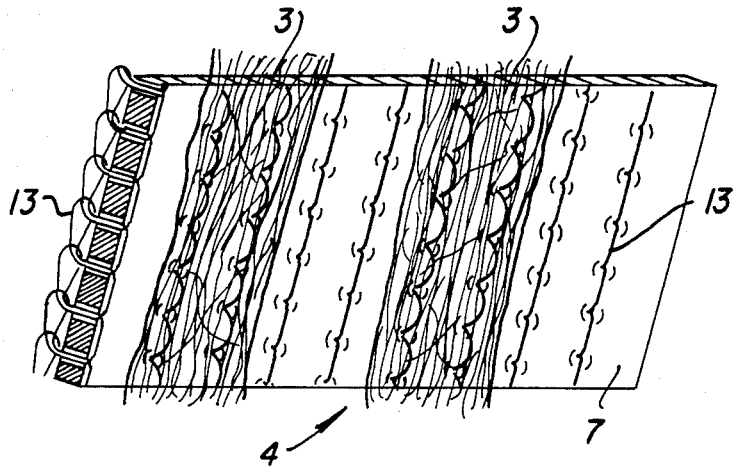
Figure 3:
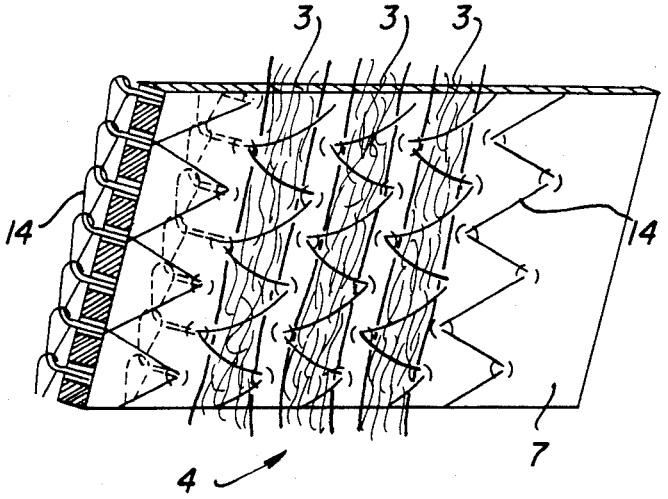
Figure 1:
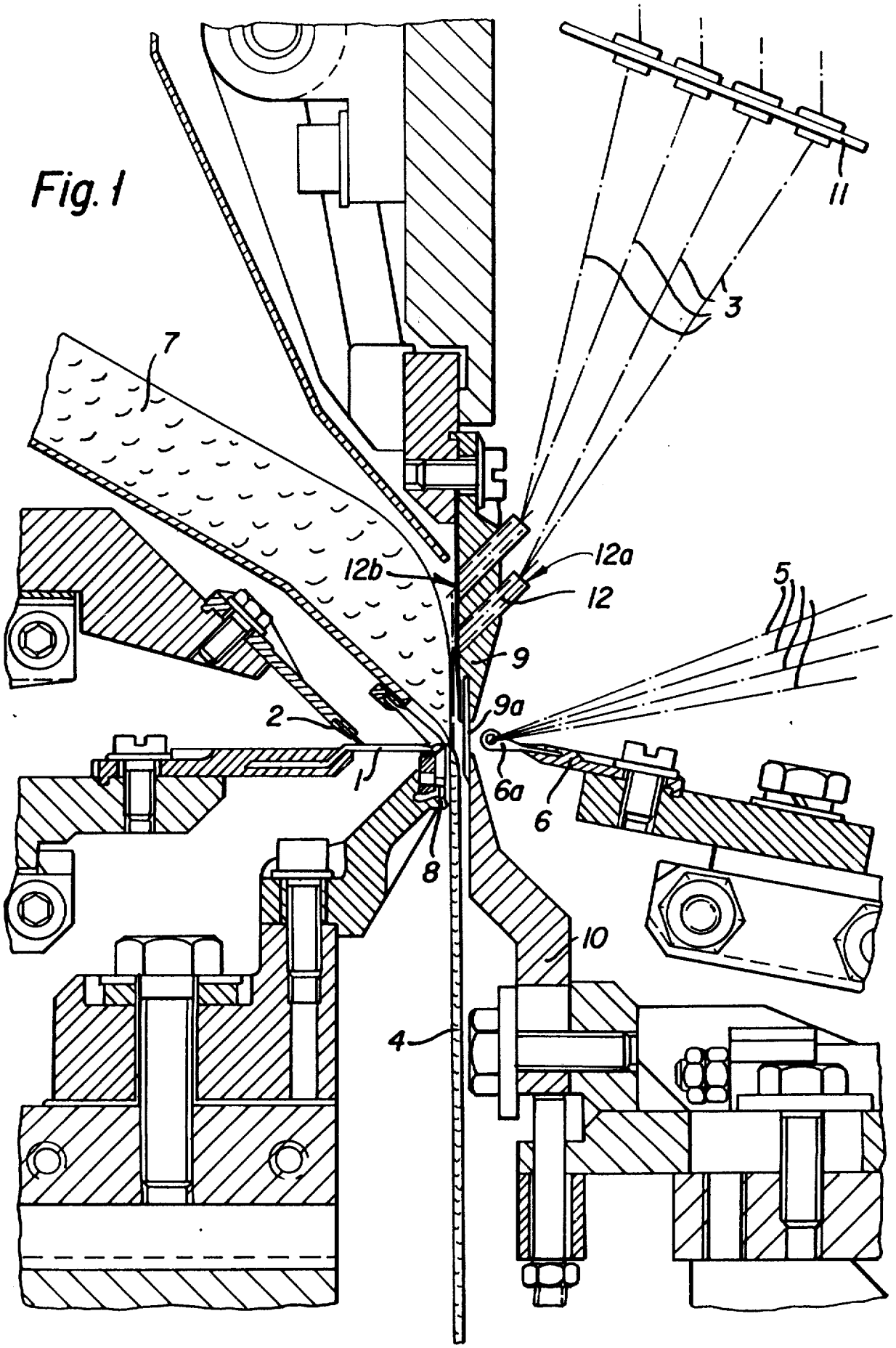

In the drawings:

FIG. 1 shows a stitch formation zone of a stitched goods machine in cross section, and FIGS. 2 and 3 are perspective views of textile fabrics that can be manufactured by the present machine.

The stitched goods machine represented in the drawing in its stitch formation zone is provided with sliding needles 1 which reciprocate and whose hooks can be opened and closed by means of closing elements 2. The sliding needles 1 are connected with stitch-forming connecting threads 5 for the purpose of manufacturing a textile fabric 4 provided with a warp element 3, the threads 5 being drawn into the track 6. In addition to warp elments 3, the textile fabric 4 comprises a base material 7, which may be a crimped fleece, a spun fleece, a thread layer, a fabric, a web, such as woven webs or the like.

The base material 7 and the finished textile fabric 4 are guided between a knock-off comb 8 and the bracing means 9, 10, in the area of the stitch formation zone. Herein, the upper bracing means is designated as 9, while the lower bracing means is designated as 10. The knock-off comb comprises sheet bars that are pointed upwardly. Pins *9a* pointing in the direction of the flow of the textile fabric 4 are a part of the upper bracing means 9, such pins *9a* being guided from the front side of sliding needles 1 into the row of sliding needles. The lower bracing means 10 is located in front of the bracing pins *9a* and below the sliding needles 1, serving as an abutment for the bracing pins *9a*.

The warp elements, which are drawn into an eyelet strip 11 above the stitch formation zone, are directed to the center of the stitch formation zone on the side of the upper bracing means 9, said stitch formation zone facing the track 6 with the perforation needles *6a*.

In the upper part of the bracing means 9, there are provided means 12 for guiding the warp elements 3, in which entrance openings *12a* for the warp elements 3 are located on the front side, while the exit openings *12b* for the warp elements 3 are located on the back side of the upper bracing means 9. The warp elements 3 are guided through the means 12 so that they will then be positioned in the center of the stitch formation zone behind the bracing means 9, 10 and in front of the base material 7, in which they are still precisely guided over sliding needles 1. In the example of the embodiment, means 12 for guiding the warp elements 3 have the form of sleeves which are rigidly connected to the upper bracing means 9, said sleeves being inclined towards the center of the stitch formation zone.

Yarns, slivers, threads, ribbons, foil strips or the like may be used as warp elements. It is immaterial whether their thickness or width is greater or less than the separation of sliding needles 1. Goods of outstanding quality goods are in particular obtainable when the warp elements 3 have a thickness that is greater than the dimensions of the distance between two adjacent sliding needles 1.

Because the warp elements 3 are located in the center of the stitch formation zone between the base material 7 and the bracing means 9,10, the risk of pushing of the warp elements 3 being pushed forward by sliding needles 1 is also eliminated, although the latter can pierce the warp elements 3 at several random places.

The stitching formation which combines the base material 7 and the warp elements 3 into a finished textile fabric 4, preferably comprises multiple vertical and horizontal rows of fringe connection or warp stitch seams. However, any other combinations which can be made by stitching, such as tricot, cloth etc. may also be used. Also, the binding combinations thus formed may be used to manufacture the textile fabric 4. Stitch formation may be sectionally interrupted in certain rows in order to produce additional design patterns which are then produced in stretches by the independent warp elements 3.

Principally, stitch formation is carried out in a way such that the sliding needles 1 on their forward movement pierce the base material 7 and move past the warp elements 3 or also piercing the latter, in order to grasp in their foremost position the connecting threads 5 by means of the sliding needle hooks and then to retract again. During withdrawal of the sliding needles 1, the closing elements 2 close the needle hooks. In a backward position, the loops that comprise threads 5 that are located on the sliding needle shanks are then thrown off by the sliding needles 1 in the form of stitch loops from stitch formation cycle to stitch formation cycle, the new loops being pulled through the latter, namely the old loops.

On the withdrawal of the sliding needles 1, in addition to the connecting threads 5, the fiber loops also have to be stitched, if the base material 7 is, for example, a crimped fleece. If the warp elements 3 have stitchable components, then the possibility exists to withdraw these in the form of loops and form stitches from them, in addition to the stitches of the connecting threads 5. In favorable cases, connecting threads 5 may be omitted, i.e. in a case where the stitching portion of the warp elements 3 is sufficient to provide a union with the base material 7. On the other hand, the warp stitching machine of this invention may also be provided with several tracks 6, when more than one system of connecting threads 5 are to be worked into the textile fabric 4.

In FIGS. 2 and 3, the textile fabric 4 has been represented, initially, by employing the fringe connection 13, and, then, with the tricot connection 14. Herein, voluminous yarns have been employed as warp elements. In the textile fabric 4 of FIG. 2, two warp elements 3 were connected to the base material 7 by means of two vertical rows of the fringe connection 13. In this case, the sliding needles 1 pierced the base material 7 and also the warp elements 3. The warp elements 3 were additionally guided at a distance from each other, in which two vertical rows of the fringe connections 13 are located. According to FIG. 3, the warp elements 3 are provided very close to each other, being affixed to the base material 7 by means of the tricot connection 14. The warp elements 3, substantially assume a position between the vertical rows of stitches and, as a rule, are not pierced by sliding needles 1, except, by chance, at some points along the edges. If even thinner warp elements 3 are introduced, then the warp elements 3 are not pierced, and the sliding needles move past the same.

We claim:

1. A warp-knitting machine, comprising:

(A) at least one sliding needle having a hook, which can be moved back and forth for penetrating a base material to be sewn, (B) at least one element for closing the hook on said sliding needle, (C) a knock-off comb positioned substantially perpendicular to said sliding needle, (D) bracing means including an upper part with at least one bracing pin, and a lower part, both parts being mounted parallel to the knock-off comb, said bracing means having a first side for contacting and thereby bracing the base material and a second side more remote from the base material, (E) at least one guiding means for a warp element to be sewn onto the base material above the stitch formation zone, which is located on the upper part of the bracing means, and (F) at least one guide needle, which leads a thread for linking the warp element with the base material, and which is positioned on a bar;

said guiding means being configured with at least one entrance opening for the warp element, which is positioned on said second side of the bracing means and which furthermore has at least one exit opening for the warp element which is positioned on said first side of the bracing means.

2. The machine according to claim 1, in which said guiding means is positioned above the bracing pin on the upper part of the bracing means.

3. The machine according to claim 1, in which said guiding means is mounted immediately over plane of movement of the sliding needle.

4. The machine according to claim 1, in which the entrance and exit openings of said guiding means form an oblique channel which opens directly above moving plane of said sliding needle.

5. The machine according to claim 4, in which a sleeve is affixed in said oblique channel.

6. The machine according to claim 5, in which a plurality of sliding needles and a plurality of channels are provided in the machine, distance between the channels in said guiding means being greater than distance between the sliding needles.

7. The machine according to claim 6, in which the channels of said guiding means are arranged in more than one row.

8. The machine according to claim 7, in which the channels in the guiding means are staggered between rows.

9. The machine according to claim 1, additionally comprising (G) at least one eyelet for guiding said warp element to said guiding means.

10. A warp-knitting machine for sewing warp elements onto a base material, comprising:

a plurality of sliding needles having hooks at front ends thereof, said sliding needles being substantially horizontally arranged and moved back and forth for penetrating the base material, a plurality of closing elements disposed adjacent to the sliding needles for closing the hooks on the sliding needles as required, a knock-off comb arranged substantially perpendicular to the sliding needles and positioned adjacent to the sliding needles so that the sliding needles pass therethrough, a track disposed away from the sliding needles for guiding threads to the sliding needles, and bracing means substantially vertically arranged between the knock-off comb and the track and having an upper part with a plurality of bracing pins at a lower end thereof and a lower part, said upper part of the bracing means including a plurality of guide means away from a plane where the sliding needles are located, said guide means guiding the warp elements to pass therethrough from the side of the bracing means where the track is disposed to the side of the bracing means where the knock-off comb is disposed to locate the warp elements adjacent to the base material before sewing together by means of the sliding needles so that the warp elements are loosely located on the base material but firmly supported by the bracing means.

* * * * *

UNITED STATES PATENT AND TRADEMARK OFFICE

CERTIFICATE OF CORRECTION

PATENT NO. : 4,503,688

DATED : March 12, 1985

INVENTOR(S) : Wolfgang Vogel et al.

It is certified that error appears in the above-identified patent and that said Letters Patent is hereby corrected as shown below:

Fig. 1 of the drawings should be added as shown on the attached sheet.

Signed and Sealed this

*Sixteenth* Day of *July 1985*

[SEAL]

*Attest:*

DONALD J. QUIGG

*Attesting Officer*

*Acting Commissioner of Patents and Trademarks*